United States Patent [19]

Hanakata

[11] 4,173,273

[45] Nov. 6, 1979

[54] PRINTER DEVICE

[75] Inventor: Takayoshi Hanakata, Yokohama, Japan

[73] Assignee: Canon Kabushiki Kaisha, Tokyo, Japan

[21] Appl. No.: 603,585

[22] Filed: Aug. 11, 1975

Related U.S. Application Data

[63] Continuation of Ser. No. 439,150, Feb. 4, 1974, abandoned.

[30] Foreign Application Priority Data

Feb. 12, 1973 [JP] Japan ..... 48-17159

[51] Int. Cl.[2] ..... B41J 3/20

[52] U.S. Cl. ..... 400/120; 400/166; 400/317; 400/320; 400/903

[58] Field of Search ..... 197/1 R; 346/76 R; 197/55, 18; 219/216

[56] References Cited

U.S. PATENT DOCUMENTS

| | | | |
|---|---|---|---|
| 2,785,039 | 3/1957 | Artzt | 346/74 |
| 3,149,901 | 9/1964 | Hagelbarger | 346/77 |
| 3,168,182 | 2/1965 | Bernard et al. | 197/55 |
| 3,357,533 | 12/1967 | Artzt | 197/1 R |
| 3,509,980 | 5/1970 | Loughery et al. | 197/1 |
| 3,596,055 | 7/1971 | Elston | 346/76 R |
| 3,632,969 | 1/1972 | Walkow | 346/76 R |
| 3,638,197 | 1/1972 | Brennan, Jr. et al. | 197/1 |
| 3,810,192 | 5/1974 | Okabe | 346/76 R |

*Primary Examiner*—Russell R. Kinsey
*Assistant Examiner*—Paul J. Hirsch
*Attorney, Agent, or Firm*—Fitzpatrick, Cella, Harper & Scinto

[57] ABSTRACT

A printer device using thermosensitive paper as a printing medium includes a thermal head for effecting printing on the printing medium, and means for moving the printing medium and the thermal head relative to each other. An electromagnetic plunger and a spring member for urging the thermal head against the printing medium are provided. The plunger serves to control the printing and, in addition, urges the thermal head against the printing medium with a predetermined pressure force, and the spring member is controlled during the relative movement between the thermal head and the printing medium along a print line on the medium, to urge the thermal head against the printing medium with a lower pressure force.

6 Claims, 2 Drawing Figures

PRINTER DEVICE

This is a continuation of application Ser. No. 439,150 filed Feb. 4, 1974, now abandoned.

BACKGROUND OF THE INVENTION

1. Field of the Invention

This invention relates to a printer device in which a printing head effects printing on a printing medium when the printing head is contacting the printing medium with a predetermined pressure force.

2. Description of the Prior Art

In electronic computers, electronic desk top calculators, cash registers, etc., there has often been employed a method of printing input or output information on a printing medium to confirm or preserve such information. The printer devices used for such printing are generally grouped into an impact system and a non-impact system.

The impact system is a system whereby type characters carried by a type carrier such as type wheel or type belt or wires arranged in a matrix form may be selected to form a letter, and then impacted against a printing medium to provide impressions thereon. By having an inked ribbon or the like interposed between the type characters and the printing medium, it is possible to employ ordinary paper as the printing medium and this leads to a low operating cost.

However, such devices are disadvantageous in that the impact imparted by the type characters to provide impressions results in the production of noises.

The non-impact system is such that a printing head capable of representing information patterns on a printing medium is urged into contact with the printing medium by a predetermined pressure force, whereby information is printed on the printing medium by thermal, electrical or electrochemical means. The non-impact system avoids the noise produced during printing, but it still suffers from some disadvantages associated with the mechanism for moving the printing head to impress a plurality of information patterns on the printing medium.

More specifically, when a letter in a line has been printed on the printing medium, the printing head must undergo a letter feed movement in preparation for printing another letter and this has heretofore been done by either one of the two methods which will be described hereinafter.

In one method, the printing head is urged into contact with the printing medium by the same pressure force both during the printing and the letter feed movement, and the letter feed occurs with the printing head under such a pressure force. Such a system leads to simplification of the mechanism for controlling the movement of the printing head and the elimination of the noises during the movement, as well. Nevertheless, if the pressure force with which the printing head must contact the printing medium during the printing is great, the friction between the moving printing head and the printing medium would result in wear to the head and/or damage of the printing medium, and this would almost preclude the use of soft materials for the printing medium. Moreover, since the printing head and the printing medium are in contact under the same pressure force, both during the movement and the printing, a large drive force is required to move the printing head and this necessitates the provision of a large motor which, in turn, results in bulkiness of the entire device.

There is still another non-impact systemf whereby the printing head during its movement is maintained out of contact with the printing medium. In such a system, the above-noted disadvantages are eliminated, but the printing head must be separated out of contact with the printing medium during each movement of the head and again brought into contact with the printing medium when the printing head has been moved to a printing position, and this causes noises, as in the impact system. Thus, the great merit of the non-impact system which is free of noise production is entirely offset.

A further disadvantage of this system is that the printing speed is reduced due to the time required, the time for separating the printing head from the printing medium when moving the former and the time required for bringing the printing head into contact with the printing head by a predetermined pressure force prior to printing.

SUMMARY OF THE INVENTION

It is an object of the present invention to provide a printer device in which noises produced during the printing and the movement of the printing head are reduced.

It is another object of the present invention to provide a printer device which is operable at high printing speeds.

It is still another object of the present invention to provide a printer device in which the wear of the printing head is reduced.

It is yet another object of the present invention to provide a printer device in which the drive force for moving the printing head may be smaller.

It is a further object of the present invention to provide a printer device in which the printing head during its printing may contact the printing medium with any pressure force and the printing head may be moved at high speeds.

It is a further object of the present invention to provide a printer device in which the printing head during its printing may contact the printing medium with any pressure force and the noises produced during the printing and the movement of the printing head may be reduced.

It is a further object of the present invention to provide a printer device which may use soft materials for the printing medium.

Other objects of the present invention will become apparent from the following detailed description taken in conjunction with the accompanying drawings.

DESCRIPTION OF THE PREFERRED EMBODIMENTS

Figures 1, 2:
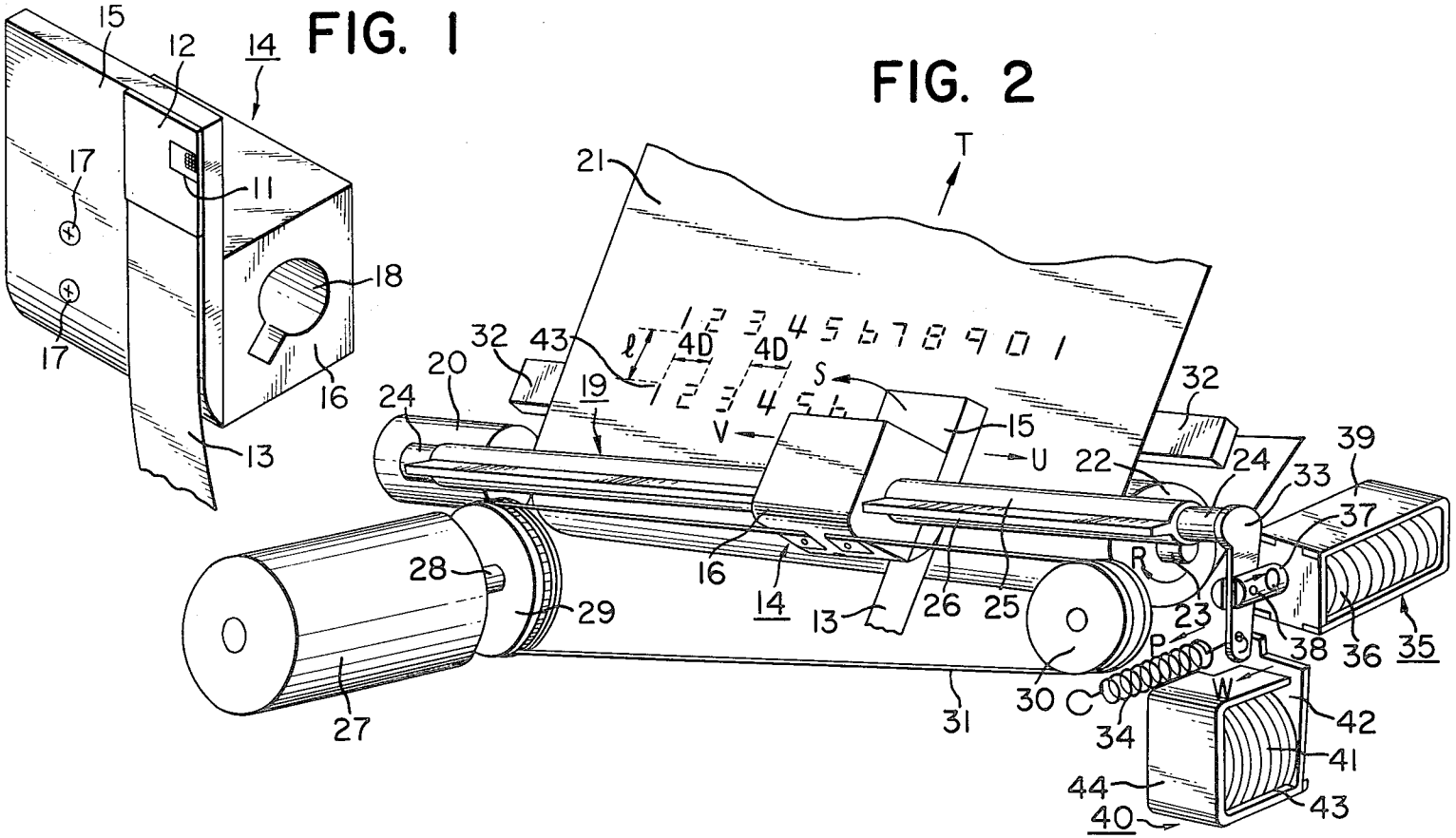
FIG. 1 is a perspective view of the head structure used with the present invention.
FIG. 2 is a perspective view showing the major portions of the printer device according to the present invention.

The invention will hereinafter be described with respect to a printer device using a thermal head as a printing head. Referring to FIG. 1, a holder means is generally designated by 14 and holds a thermal head 11. This printing head, as is disclosed in U.S. Pat. No. 3,496,333, for example, comprises thermally independent islands arranged in a matrix form so that an electrical signal for selecting one of such islands may be applied to thereby provide heating of the selected island. The thermal head 11 is secured to a substrate 12 which may be of ceramic, or the like, material and a lead 13 for applying the signal for selecting the islands in the thermal head may be secured to the substrate.

The substrate 12 with the thermal head 11 and the lead 13 secured thereto, as described, is, in turn, secured, as by adhesive, to a radiator plate 15, formed of aluminum or other material or good heat conductivity, to form a part of the holder means 14. The radiator plate 15 is also secured, as by screws 17, to a base 16 formed of plastics or like high molecular material and forming another part of the holder means 14.

The base 16 has a bore 18 formed therethrough. The bore 18 is of non-circular cross section so as to permit the base 16 to be slidably mounted on a rail 19 extending through the bore 18 and to permit the base 16 to rotate with the rotation of the rail 19, as is shown in FIG. 2.

FIG. 2 illustrates a printer device employing the holder means 14, as shown in FIG. 1. A web of thermal paper 21, which is a recording medium capable of coloring in response to the application of heat thereto, may be wrapped around a paper feed roller 22 having its entire circumferential surface covered with a rubber-like elastic material. The roller 22 has its rotary shaft 23 rotatably journalled in a structural member not shown. A motor 20 rotates the roller in the direction of arrow R, to thereby feed the thermal paper in the direction of arrow T. The structural member mentioned above serves as a mounting member for the various parts, but is not shown in FIG. 2 for simplicity and clarity of the illustration.

The rail 19 extends substantially perpendicularly to the direction of movement of the thermal paper 21 so as to support the holder means 14 in a slidable manner, as mentioned above, and is arranged to rotate the holder means 14 in the direction of arrow S to bring the thermal head 11 out of contact with the thermal paper 21. The rail 19 is rotatable with respect to the structural member by means of cylindrical journal portions 24 provided at the opposite ends of the rail and rotatably journalled to the structural member.

The rail 19 is of a cross section substantially complementary to that of the bore 18 formed through the base 16 and, more particularly, it comprises a cylindrical portion 25 and a projected portion 26 and extends substantially parallel to the roller 22 and in substantially predetermined spaced relationship therewith. Thus, with the holder means 14 inserted over the rail 19 through the bore 18, the holder means 14 is freely slidable on the rail 19 and rotatable with the rail 19 with the rotation of the latter.

A pulse motor 27 is secured to the structural member and has a pulley 29 securely mounted on its shaft 28 so that the pulley 29 is rotatable upon energization of the pulse motor 27. A second pulley 30 is rotatably mounted on the structural member in another portion thereof. A length of strings 31 extends over and between the pulleys 29 and 30 and a part of the string 31 is fixed to the bottom of the base 16. Thus, upon energization of the pulse motor 27, the head structure 11 is movable on the rail 19 in the direction of arrow U or V. Designated by 32 is a printing bed having its opposite ends secured to the structural member so that the thermal paper 21 may be urged against the printing bed 32 with a predetermined pressure force by the thermal head 11. That portion of the printing bed 32 which corresponds to the thermal head 11 forms a surface substantially parallel to the surface portion provided by the thermal head 11 during the press of the latter.

An arm 33 is secured to one of the cylindrical journal portions 24 of the rail 19, and a spring 34 is secured at one end to a portion of the arm 33 and at the other end to the structural member so as to bias the arm 33 in the direction of arrow P. This spring 34 serves to urge the thermal head 11 against the thermal paper 21 with a relatively low pressure (of the order of 10 to 100 g.). The order of the pressure implies that such pressure is applied to a thermal head of 3.5mm×3.5mm.

A plunger 35 is provided which has a coil 36 and a movable member 37, which is movable in the direction of arrow Q upon excitation of the coil 36. The end of the movable member 37 is rotatably secured to a portion of the arm 33 by means of a pin 38, and the frame member 39 of the plunger 35 is fixedly secured to the structural member. Upon application of a predetermined current to the coil 36, the movable member 37 is moved in the direction of arrow Q against the tension force of the spring 34. Thus, energization of the plunger 35 causes the holder means 14 to be moved in the direction of arrow S by means of the arm 33 and rail 19, thereby bringing the thermal head 11 out of contact with the thermal paper 21.

A second plunger 40 is provided which has a coil 41 and a rockable plate 42, which is rockable about its lower end 43 in the direction of arrow W upon excitation of the coil 41. The frame member 44 of the second plunger is fixedly secured to the structural member and the upper end of the rockable plate 42 bears against the lower end portion of the arm 33.

Thus, a predetermined current applied to the coil 41, in addition to the tension force of the spring 34, causes the rockable plate 42 to be biased in the direction of arrow W so that the holder means 14 urges the thermal head 11 against the thermal paper 21 with a pressure force, say, 4kg/cm$^2$, higher than the force imparted solely by the spring 34.

On the thermal paper 21, printing must be provided in suchy a manner that a character is printed in a line, whereafter a next character is printed in the line at a predetermined distance $\Delta D$ from the preceding character, as is shown in FIG. 2.

To accomplish this, it is necessary that the thermal head 11 remain stationary while it is printing a character or the thermal paper 21 and that the thermal head 11 be moved laterally by a distance $\Delta D$ when it has printed the character. According to the present invention, the thermal head maintains its contact with the thermal paper 21 at least during the printing, and the movement of the thermal head 11 in a line and the contact pressure of the thermal head 11 against the thermal paper 21 is controlled so as to be variable between the time of printing and the time of movement.

The contact pressure of the thermal head 11 against the thermal paper 21 will be described more particularly with reference to FIG. 2. When a character such as number "1" designated by reference numeral 43 is to be printed on the thermal paper 21 by the thermal head 11, the thermal head 11 contacts the thermal paper 21 with a predetermined pressure a by passing a predetermined current to the coil 41 of the plunger (such current may be set such that the contact pressure between the thermal head 11 and the thermal paper 21 assumes a predetermined value a through the combination of the spring 34 and the plunger 40), whereupon a driving signal for "1" is applied from a thermal head drive circuit not shown to the lead 13 for a very short period of time, thereby printing "1" on the thermal paper.

When printing has been so effected, the plunger 40 is deenergized and a driving pulse is applied to the pulse motor 27 to move the thermal head by an amount ΔD in the direction of arrow U.

During the letter feed movement, the plunger 40 is deenergized so that the thermal head 11 makes its contact with the thermal paper 21 with a low contact pressure b imparted solely by the spring 34, and thus the thermal head can be readily moved while maintaining a light contact with the thermal paper. This means that the thermal head takes only a very short time to shift from its printing position into its movement mode.

When the thermal head 11 has come to a halt after its predetermined letter feed movement ΔD, the plunger 40 is re-energized to cause the thermal head 11 to contact the thermal paper 21 with a contact pressure a while a driving signal for "2" is applied from the thermal head drive circuit to the lead 13, thereby printing "2" on the thermal paper 21.

In this manner, printing is effected on the thermal paper 21 by causing the thermal head 11 to shift from the condition in which it contacts the thermal paper 21 with the contact pressure b into the condition in which it contacts the thermal paper 21 with the contact pressure a, and the entry of the thermal head into its printing condition occurs with only its contact pressure being varied, thus eliminating the noise which would otherwise be produced during the printing.

When a line of printing has been completed in the described manner, the motor 20 must be energized to drive the roller 22 for a predetermined angular rotation in the direction of arrow R to thereby feed the thermal paper 21 by a distance l in the direction of arrow T while driving the holder means 14 in the direction of arrow V to return the thermal head 11 to a position for initiating the printing of a new line (i.e. the position aligned with the numerical character "1" designated by 43). During such a line feed, a predetermined current (which may be a current sufficient to bring the thermal head 11 out of contact with the thermal paper 21 against the tension force of the spring 34) is applied to the plunger 35 to release the thermal head 11 from its contact with the thermal paper 21 while a driving pulse is applied to the pulse motor 27 to move the holder means 14 in the direction of arrow V until it reaches a predetermined position, whereupon the plunger 35 is deenergized.

Thus, during the line feed, the wear of the thermal head 11 resulting from its frictional contact with the thermal paper 21 may be minimized by the thermal head 11 being kept out of contact with the thermal paper 21.

However, if the wear of the thermal head is permissible, the plunger 35 may be eliminated. More specifically, during the line feed, the plunger 40 may be deenergized to cause the thermal head 11 to contact the thermal paper 21 with a pressure force b and under such conditions, the pulse motor 27 may be energized to move the holder means 14 in the direction of arrow V to thereby accomplish the line feed.

Also, when the plunger 35 is so eliminated in the printer device, the spring 34 may also be eliminated, with the plunger 40, only available for the purpose, if the situation permits increased power comsumption by the plunger 40.

The plunger 40 is constructed so that its force for driving the rockable plate 42 in the direction of arrow W is controllable by the current flowing through the coil 41. Therefore, when the spring 34 has been eliminated in the above-described embodiment, such elimination of the spring 34 may be compensated for by always passing a predetermined weak current to the coil 41 of the plunger 40 so that the arm 33 receives a force equal to the force imparted thereto by the spring 34 in the direction of arrow P, thereby ensuring the thermal head 11 to contact the thermal paper 21 with the pressure force b.

I claim:

1. A printer device comprising:

a printing medium of thermosensitive paper;

a rotatable guide rail disposed in parallel with said printing medium;

holder means slidably mounted on said guide rail and pivotable in accordance with the pivotal movement of said guide rail;

a thermal head for recording on said printing medium fixed to said holder means;

thermal head moving means for moving said thermal head along said guide rail in one direction and in another direction;

spring means for urging said guide rail to rotate in a first rotational direction to contact said thermal head with said recording medium with a first pressing force, when said thermal head is in non-recording position and is moved along said guide rail by said moving means in said one direction along said guide rail;

first electromagnetic drive means for further urging, in addition to the urging of the guide rail in the first rotational direction by said spring means, said guide rail to rotate in said first rotational direction to contact said thermal head with said recording medium with a second pressing force larger than said first pressing force, when said thermal head is in recording position and is stopped on said guide rail; and second electromagnetic drive means for urging, against the urging of the guide rail in the first rotational direction by said spring, said guide rail to rotate in a second rotational direction opposite to said first rotational direction to place said thermal head out of contact with said recording medium, when said thermal head is moved, by said moving means, in said other direction opposite to said one direction of the movement thereof.

2. A device according to claim 1, further comprising an arm fixedly mounted on at least one end of said guide rail, at least one of said spring means and said electromagnetic drive means being fixed on said arm.

3. A device according to claim 1, wherein said moving means includes a motor and a pulley-belt assembly for transmitting drive force of said motor to said holder.

4. A device according to claim 3, further comprising roller means for moving said printing medium in a direction substantially perpendicular to said guide rail, and a second motor for driving said roller means.

5. A device according to claim 1, wherein said holder means is provided with heat radiation means made of a material of high thermal conductivity such as a metal.

6. A printer device comprising:

a printing medium of thermosensitive paper;

a rotatable guide rail disposed in parallel with said printing medium;

holder means slidably mounted on said guide rail and pivotable in accordance with the pivotal movement of said guide rail;

arm means fixedly mounted on said guide rail;

a thermal head for recording on said printing medium fixed to said holder means;

thermal head moving means including a belt for moving said thermal head along said guide rail in one direction and in another direction, and a motor for driving said belt, a part of said belt being fixed to said holder means;

spring means for urging said arm means to rotate in a first rotational direction to contact said thermal head with said recording medium with a first pressing force within a range between about 10 to about 100 grams per 3.5 millimeters square, when said thermal head is in non-recording position and is moved along said guide rail by said moving means in said one direction along said guide rail;

first electromagnetic drive means for further urging, in addition to the urging of the guide rail in the first rotational direction by said spring means, said arm means to rotate in said first rotational direction to contact said thermal head with said recording medium with a second pressing force larger than said first pressing force, when said thermal head is in recording position and is stopped on said guide rail; and second electromagnetic drive means for urging, against the force exerted by said spring means urging said guide rail in the first rotational direction, said arm means to rotate in a second rotational direction opposite to said first rotational direction to place said thermal head out of contact with said recording medium, when said thermal head is moved, by said moving means, in said other direction opposite to said one direction of the movement thereof.

* * * * *

UNITED STATES PATENT AND TRADEMARK OFFICE

CERTIFICATE OF CORRECTION

PATENT NO. : 4,173,273

DATED : November 6, 1979

INVENTOR(S) : TAKAYOSHI HANAKATA

It is certified that error appears in the above-identified patent and that said Letters Patent are hereby corrected as shown below:

Col. 2, line 3, change "systemf" to --system--;
line 19, change "head" to --medium--.

Col. 3, line 5, after "like" delete the ","; same line, after "material" insert a --,--.

Col. 4, line 43, change "suchy" to --such--;
line 64, after "pressure" change "a" to --a--;
line 68, after "value" change "a" to --a--.

Col. 5, line 12, change "b" to --b--;
line 20, after "pressure" change "a" to --a--;
line 27, change "b" to --b--;
line 29, after "sure" change "a" to --a--;
line 37, after "distance" change "l" to --l--;
line 60, after "force" change "b" to --b--.

Col. 6, line 12, after "force" change "b" to --b--.

Signed and Sealed this

*Fifteenth* Day of *April 1980*

[SEAL]

*Attest:*

SIDNEY A. DIAMOND

*Attesting Officer*

*Commissioner of Patents and Trademarks*